United States Patent [19]

Miura et al.

[11] Patent Number: 4,861,401

[45] Date of Patent: Aug. 29, 1989

[54] METHOD OF INJECTING ADHESIVES INTO CRACKS

[75] Inventors: Ryuichi Miura, Kyoto; Toshinobu Nakao, Kawanishi, both of Japan

[73] Assignees: Konishi Co., Ltd., Osaka; Sunkit Co., Ltd., Kobe, both of Japan

[21] Appl. No.: 133,465

[22] Filed: Dec. 15, 1987

[30] Foreign Application Priority Data

Jul. 3, 1987 [KR] Rep. of Korea ..... 1987-7090

[51] Int. Cl.[4] ..... B32B 35/00

[52] U.S. Cl. ..... 156/94; 264/36; 425/12; 425/13

[58] Field of Search ..... 156/94; 264/36; 425/12, 425/13; 604/208

[56] References Cited

U.S. PATENT DOCUMENTS 3,905,521 9/1975 Mead et al. ..... 604/208 X 3,993,520 11/1976 Werner et al. ..... 156/94

*Primary Examiner*—Robert A. Dawson

*Attorney, Agent, or Firm*—Griffin, Branigan & Butler

[57] ABSTRACT

A method of injecting adhesives (7) into cracks (2) of structures (1) for sealing the cracks, involves affixing injection pipes (4) on non-sealed surface portions of the structures at the cracks and connecting an adhesives injection device (10) to each one of the injection pipes. The injection devices are comprised of transparent cylinders having scales thereon graduated toward injection, nozzles (17) thereof, and of pistons (13) which can move linearly in both directions in the cylinders. The nozzles are respectively connected to the injection pipes after adhesives are drawn into the cylinders, and the pistons are moved toward the nozzles by compression, or pushing pressure, of rubber or springs to inject the adhesives into the cracks.

2 Claims, 2 Drawing Sheets

METHOD OF INJECTING ADHESIVES INTO CRACKS

BACKGROUND OF THE INVENTION

This invention relates to a method of injecting adhesives into cracks of structures by sealing surface portions of the structure outside of the cracks, attaching injection pipes on surface portions of the structures at the cracks and connecting an adhesives injecting device to each one the injection pipes To repair cracks in concrete, stone, and other non-organic materials, it has been practiced to inject adhesives of liquid or grease-like materials into the cracks. Such, injections have been made at high-pressures and high-speeds or at low-pressures and low-speeds, depending on crack conditions and the kinds of adhesives used. In the former case, the working time required has been fairly short and efficiency has been high. In the latter case, however, the working time has been longer and the work efficiency has been low. When a large number of cracks have been repaired, and the total length of the cracks has been therefore long, large numbers of workers have been required to make these injections. Such prolonged work at elevated positions may injure workers' health in either a hot or a cold climate.

Internal volumes of cracks can't be judged from outside a cracked structure, and it is difficult to know exactly the quantity of adhesives injected into cracks. When material is simply poured into cracks it is difficult to calculate how much material has been used.

A primary object of this invention is to enable quick work but yet to allow one to easily determine the quantity of adhesives used, even when one works with a low pressure at a slow speed.

SUMMARY

According to principles of this invention cracks in structures are sealed by:

(a) Providing an injecting device with a transparent cylinder having a scale graduated from a rear end toward a nose, or nozzle, the injecting device having a piston which can move forward and backward in the cylinder:

(b) affixing an injection pipe on a surface of the structure;

(c) Connecting the nozzle end of the injecting device to the injection pipe after drawing or filling adhesives into the cylinder: and (d) Moving the piston forward using contraction or pushing pressure of rubber or springs.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 2:
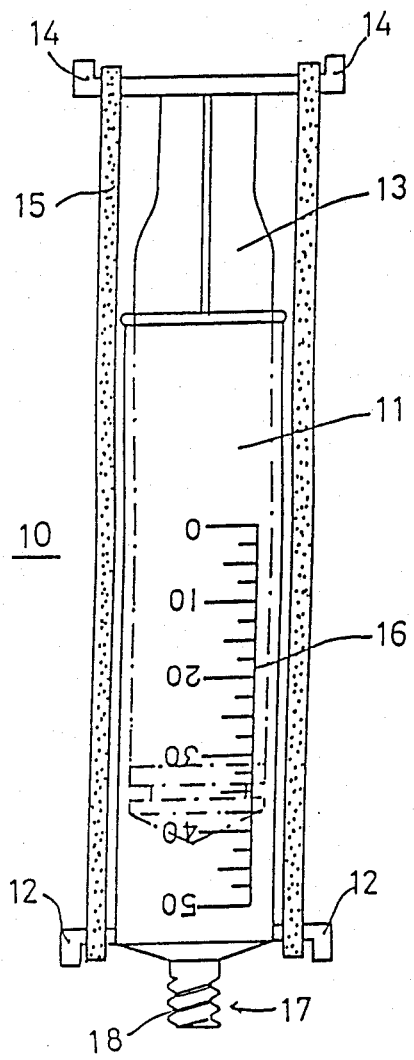
FIG. 2 is a front view of the injecting device of the injecting assembly of FIG. 1.
Figure 1:
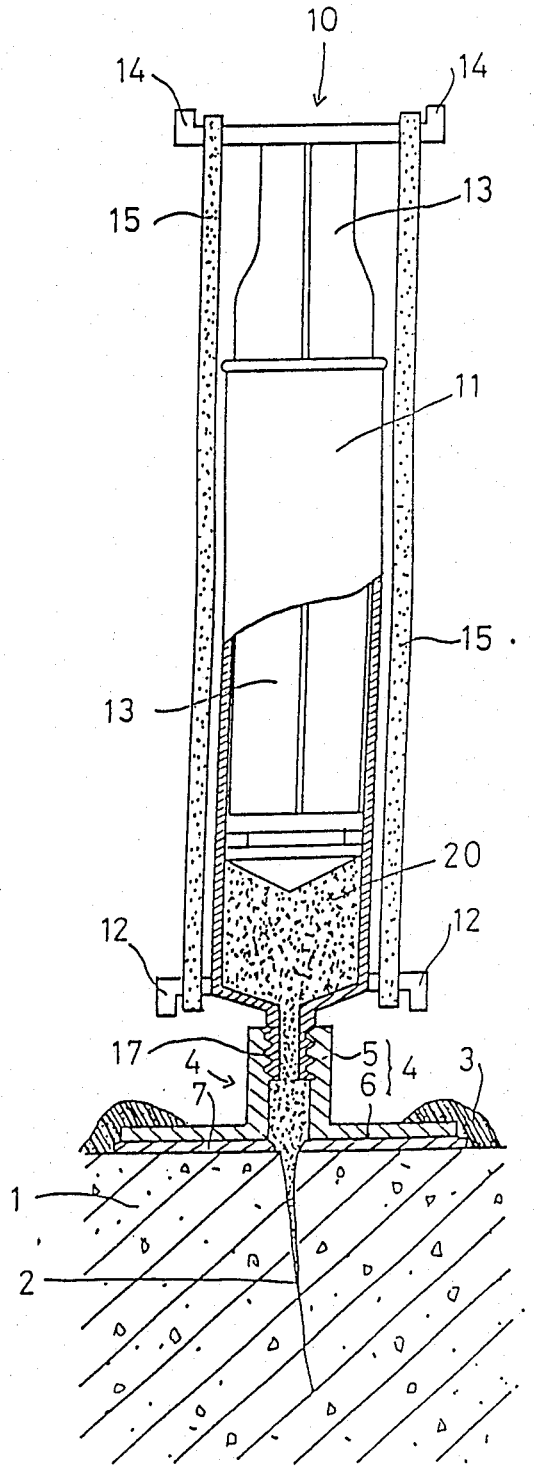
FIG. 1 is a front, partially sectional, view of an adhesive injecting assembly of this invention mounted on a concrete structure having a crack.

Referring now to the drawings, an adhesive injection device 10 is set at a crack 2 in a concrete structure 1.

Organic or non-organic sealing agent 3 is coated on a surface of the structure 1. This could be a type of hot metal placed on the surface and heated, or it could be putty which is buried into the surface of the structure 1. In any case, this sealing agent 3 will close off cracks at the surface of the structure.

An injection pipe 4 comprises a doughnut shaped plate 6 made as a solid piece with a bottom end of a pipe 5. The plate 6 is fixed to the surface of the structure 1 directly at the crack 2 with an adhesive 7, as illustrated.

The injection pipe 4 may also be fixed onto the structure 1 by anchor bolts (not illustrated) or by bonding it to the surface of the coated seal 3.

In the injecting device 10 used for this embodiment a piston 13 is advanced by contraction of rubber bands 15 of a high expansion-contraction performance into the cylinder 11. Hooks 12, 14 are projected to both sides at a nose, or nozzle, of the cylinder 11 and at a rear end of the piston 13 respectively, and the rubber bands 15 are set on these projections to move the piston 13 forward to force adhesive agent through the cylinder 11 into the crack 2.

The cylinder 11 is made of transparent polycarbonate resin and has a scale 16 marked on a side thereof. The scale 16 is graduated from a rear end of the cylinder 11 toward the nose, or nozzle, end, and can measure 50 cc adhesive agent maximum (See FIG. 2). A nozzle 17 at the nose end of the cylinder 11 has a spiral male thread 18 on the outside and can be screwed to the injection pipe 4, which is fixed over the crack 2.

An adhesive agent 20 is drawn into the cylinder 11 in advance, the nozzle 17 is then connected to the injection pipe 4, the rubber belts 15 are set between the hooks 12, 14, and then the piston 13 moves forward to slowly inject the adhesive agent 20 into the crack 2.

Figure 3:
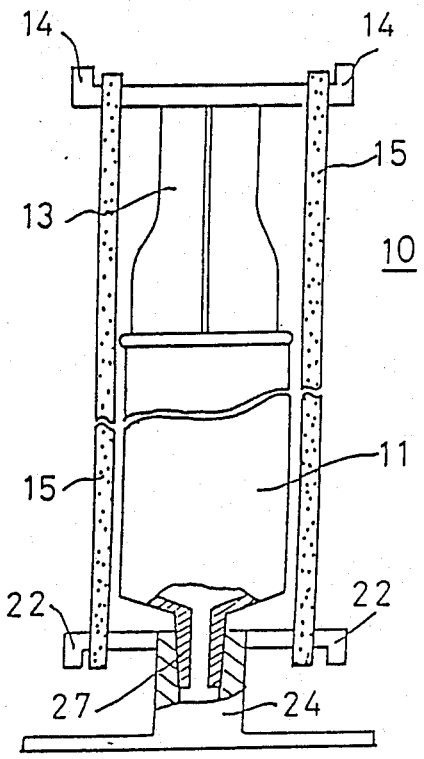
FIG. 3 is a front, partially sectional, view of an alternate embodiment injecting assembly of this invention.

In an alternate embodiment depicted in FIG. 3 the rubber belts 15 may be set onto hooks 22 projecting from the injection pipe 4 instead of the hooks 12 at the nose end of the cylinder as shown in FIG. 3. It may also be possible to press the piston at a part between the hooks going across the rear end of the piston, with the other end of a rubber belt extending to either the hooks 12 of FIG. 2 or the hooks 22 of FIG. 3.

In the arrangement of FIG. 3, the rubber belts 15 aid in holding the injecting device 10 on an injection pipe 24, and there is no worry of the injecting device 10 falling off the injection pipe 24 when a nozzle 27 is screwed into the injection pipe 24. In this case, it may also be possible to place an elastic body, made of rubber or the like, between the nozzle 27 and the injection pipe 24 to ensure watertight condition between the two. Also, a holder made of rubber can be placed onto the injection pipe 4 for receiving the nozzle 27 into the holder. In the latter case, the cylinder 11 can swing to some extent and the nozzle 27 or the injection pipe 24 will not be damaged even if a worker disturbs the cylinder.

For the above embodiments, rubber belts are used to advance the piston 13; however, it is also possible to set fine coil springs between the hooks in place of the rubber belts and to use the compression force of the springs. The piston may also be advanced by using expanding force of coil springs placed behind the piston.

It should be understood that adhesives can be drawn or filled into the cylinder simply by moving the piston rearward and no other devices are required. The nozzle of the cylinder is simply connected to the injection pipe fixed at a crack, and then the piston is automatically moved forward by contraction or pushing pressure of rubber or springs to inject adhesives into the crack while the injecting device is left as it is.

It will be appreciated by those of ordinary skill in the art that even when adhesives are injected at a low pressure and at a low speed the injecting work can be efficiently and quickly accomplished because injection can be made simply by connecting respective injecting devices to ones of a plurality of injecting pipes fixed at cracks, one after another. The piston is pulled back first to zero scale, drawing, or filling, adhesives into the cylinder. Therefore, advance of the piston directly indicates the quantity of adhesives injected into a crack, and the injecting quantity can be known at a glance by looking at the graduated scale without the need for calculation.

As injection of adhesives can be made quickly with this invention and the injected quantity is known exactly, there is no need for a worker to keep holding a gun for adhesive injection for a long time, which serves to prevent the worker from being injured.

Another advantage of this invention is that a total quantity of adhesives used can be known simply by adding readings on cylinder scales. There is no need to carry heavy equipment such as adhesive mixers and fillers to cracks as adhesives are drawn into the injecting device in advance.

Since only a cylinder containing adhesives for each crack is carried, the preliminary process before injection can be simpler.

It never happens that the adhesive agent flows back out of a crack after injection because the piston is continually pressed into the crack by rubber bands or springs, and injection work can be continued without worrying. Additional injection where a crack needs more than one cylinder of adhesive is also possible by changing injecting devices one after another.

What is claimed is:

1. A method of injecting adhesives into cracks of a structure comprising the steps of:

sealing a crack at the surface of the structure but providing non-sealed surface portions with adequate space to affix at the surface an injection pipe;

affixing an injection pipe at the surface said crack;

connecting a nozzle end of an adhesives injecting device to said injection pipe, said injecting device being composed of a transparent cylinder having a scale graduated from a rear end toward the nozzle end and of a piston which can move forward and rearward in said cylinder; and utilizing the resilience of an elastic member attached between said piston and a nonmoveable member to move said piston toward said nozzle to inject said adhesives into said crack.

2. A method as in claim 1, wherein a plurality of injection pipes and adhesives injecting devices are used, one respectively for each crack.

* * * * *